US005353819A

United States Patent [19]

Kahn et al.

[11] Patent Number: 5,353,819

[45] Date of Patent: Oct. 11, 1994

[54] LOTION WAND

[76] Inventors: Michael N. Kahn, 11 Juheau Blvd., Woodbury, N.Y. 11797; George Spector, 233 Broadway Rm 702, New York, N.Y. 10279

[21] Appl. No.: 47,955

[22] Filed: Apr. 19, 1993

[51] Int. Cl.[5] ..... A45D 40/26

[52] U.S. Cl. ..... 132/320; 401/6; 401/183; 401/207

[58] Field of Search ..... 132/289, 290, 320; 401/6, 183, 207

[56] References Cited

U.S. PATENT DOCUMENTS

| | | | |
|---|---|---|---|
| 2,820,234 | 1/1958 | Rigney | 401/207 |
| 2,897,526 | 8/1959 | Dootson | 132/289 |
| 2,947,015 | 8/1960 | Burt | 401/183 |
| 4,008,968 | 2/1977 | Hobbs | 401/183 |
| 4,078,865 | 3/1978 | Moser | 401/207 |
| 4,144,967 | 3/1979 | Craven et al. | 132/290 |
| 4,299,005 | 11/1981 | Brown | 401/6 |
| 4,558,966 | 12/1985 | Mikuteit | 401/247 |
| 4,594,015 | 6/1986 | Pomares | 401/183 |
| 4,961,661 | 10/1990 | Sutton et al. | 401/6 |
| 4,998,545 | 3/1991 | Hiromura | 132/289 |
| 5,028,158 | 7/1991 | Fey | 401/183 |
| 5,087,138 | 2/1992 | Terbrusch et al. | 401/6 |

*Primary Examiner*—Gene Mancene
*Assistant Examiner*—Frank A. LaViola

[57] ABSTRACT

A lotion wand is provided for dispensing suntan lotion from a suntan lotion squeeze bottle having a neck. The wand consists of a cap sized to fit over and engage with the neck of the suntan lotion squeeze bottle. A hollow tube extends upwardly form the cap. A holder is slightly angularly positioned on an upper end of the hollow tube. A sponge having a central aperture is carried in the holder. When the squeeze bottle is compressed the suntan lotion will travel through the hollow tube into the sponge from the central aperture to allow a user to reach their entire body to apply the suntan lotion thereto.

1 Claim, 1 Drawing Sheet

LOTION WAND

BACKGROUND OF THE INVENTION

The instant invention relates generally to liquid applicators and more specifically it relates to a lotion wand which provides the user to apply lotion directly from a bottle to any part of the body, thereby keeping the hands clean and free from contacting the lotion.

There are available various conventional liquid applicators which do not provide the novel improvements of the invention herein disclosed.

SUMMARY OF THE INVENTION

A primary object of the present invention is to provide a lotion wand that will overcome the shortcomings of the prior art devices.

Another object is to provide a lotion wand that replaces the cap of a suntan lotion squeeze bottle to allow the user to reach the entire body, especially areas between the shoulder blades and behind the legs when seated in a beach lounge.

An additional object is to provide a lotion wand in which the suntan lotion will go directly from the squeeze bottle into the lotion wand to be rubbed onto the body, thereby keeping the hands clean and free from contacting the lotion.

A further object is to provide a lotion wand that is simple and easy to use.

A still further object is to provide a lotion wand that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
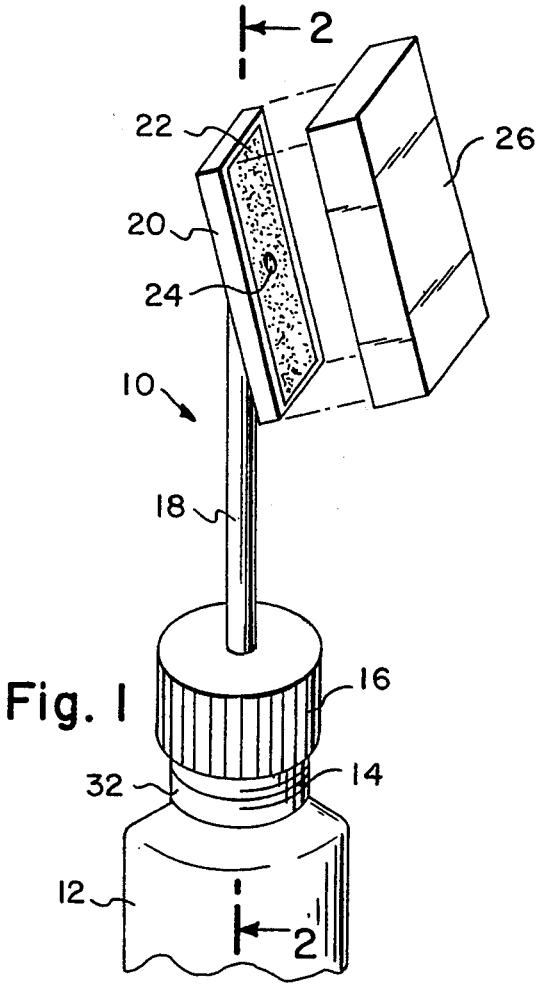
FIG 1 is a perspective view of the instant invention on a lotion bottle with the cap exploded therefrom.
Figure 2:
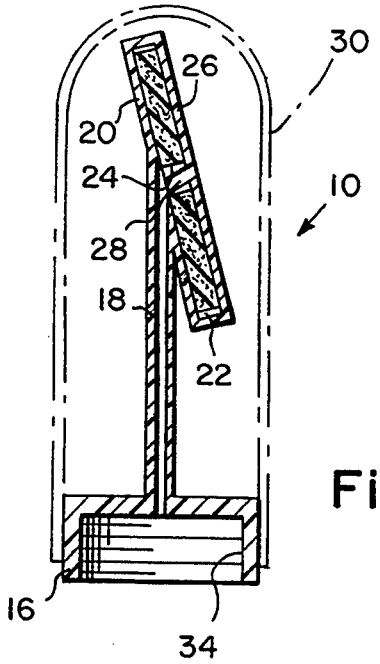
FIG. 2 is a cross sectional view taken along line 2—2 in FIG. 1 of the instant invention per se.

Turning now descriptively to the drawings, in which similar reference characters denote similar elements throughout the several views, FIGS. 1 and 2 illustrate a lotion wand 10 for dispensing suntan lotion from a suntan lotion squeeze bottle 12 having a neck 14. The wand 10 consists of a cap 16 sized to fit over and engage with the neck 14 of the suntan lotion squeeze bottle 12. A hollow tube 18 extends upwardly from the cap 16. A holder 20 is slightly angularly positioned on an upper end of the hollow tube 18. A sponge 22 having a central aperture 24 is carried in the holder 20. When the squeeze bottle 12 is compressed the suntan lotion will travel through the hollow tube 18 into the sponge 22 from the central aperture 24 to allow a user to reach their entire body to apply the suntan lotion thereto.

The lotion wand 10 further includes a cover 26 to fit over the holder 20 and the sponge 22. A plug 28 is centrally formed and located within the cover 26 to fit into the central aperture 24 in the sponge 22 to prevent leakage of the suntan lotion therefrom when not being used.

A snap on sleeve 30 engages with the cap 16 and is sized to fit over and protect the hollow tube 18, the holder 20 with the sponge 22 and the cover 26 with the plug 28 for storage purposes. The neck 14 of the suntan lotion squeeze bottle 12 is externally threaded at 32 and the cap 16 is internally threaded at 34, so that the cap 16 can be threaded onto the neck 14.

Figure 4:
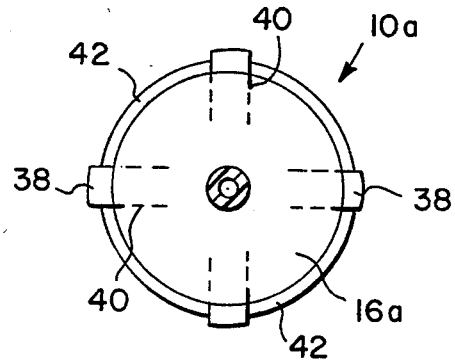
FIG. 4 is a cross sectional view taken along line 4—4 in FIG. 3 showing perforations at each bendable finger, so that the cap can fit upon various diameter bottle necks.
Figure 3:
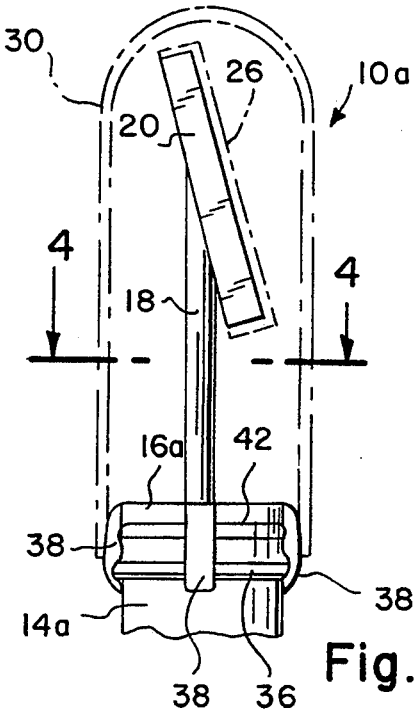
FIG. 3 is a side view of a modification in which bendable fingers and a sealing flap on the cap will engage about the bottle neck.

A modified lotion wand **10*a* is shown in FIGS. 3 and 4, when the neck 14*a* of the suntan lotion squeeze bottle is externally beaded at 36. The cap 16*a* contains a plurality of bendable fingers 38 extending radially about the cap 16*a*. Each of the fingers 38 has perforations 40 extending into the cap 16*a*, so that the fingers 38 can engage with various sized externally beaded necks 14*a*. A segmented sealing flap 42 extends radially about the cap 16*a* between the bendable fingers 38 to prevent leakage from the cap 16*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A lotion wand for dispensing suntan lotion from a suntan lotion squeeze bottle having a neck, said wand comprising:

a) a cap adapted to fit over and engage with said neck of said suntan lotion squeeze bottle;

b) a hollow tube extending upwardly from said cap;

c) a holder with a central hole communicating with said tube, slightly angularly positioned on an upper end of said hollow tube;

d) a sponge having a through central aperture aligned with said hole carried fully within said holder so that when said squeeze bottle is compressed said suntan lotion will travel through said hollow tube into said sponge from said central aperture to allow a user to reach their entire body to apply said suntan lotion thereto; further in combination with a squeeze bottle including a snap on sleeve to engage with said cap and sized to fit over and protect said hollow tube, said holder with said sponge and said cover with said plug for storage purposes; wherein said neck of said suntan lotion squeeze bottle is externally beaded and said cap includes:

e) a plurality of bendable fingers extending radially about said cap, each of said fingers having perforations extending into said cap so that said fingers can engage with various sized externally beaded necks; and f) a segmented sealing flap extending radially about said cap between said bendable fingers to prevent leakage from said cap.

* * * * *